United States Patent [19]

Kato et al.

[11] Patent Number: 5,056,417

[45] Date of Patent: Oct. 15, 1991

[54] SWASH PLATE TYPE COMPRESSOR HAVING A SURFACE COATING LAYER ON THE SURFACE OF SWASH PLATE

[75] Inventors: Masafumi Kato; Takenori Sawa; Futoshi Sakata; Yoshifumi Kato, all of Kariya, Japan

[73] Assignee: Kabushiki Kaisha Toyoda Jidoshokki Seisakusho, Kariya, Japan

[21] Appl. No.: 434,240

[22] Filed: Nov. 13, 1989

[30] Foreign Application Priority Data

Nov. 11, 1988 [JP] Japan ..... 63-286479

[51] Int. Cl.[5] ..... F01B 3/00

[52] U.S. Cl. ..... 92/71

[58] Field of Search ..... 92/70, 71, 122; 417/269; 91/499; 384/912

[56] References Cited

U.S. PATENT DOCUMENTS

| | | | |
|---|---|---|---|
| 4,037,522 | 7/1977 | Inoshita et al. | 92/71 |
| 4,285,640 | 8/1981 | Mukai | 417/269 |
| 4,307,998 | 12/1981 | Nakayama et al. | 417/269 |
| 4,551,395 | 11/1985 | Lloyd | 384/912 |
| 4,568,252 | 2/1986 | Hattori et al. | 92/71 |
| 4,662,267 | 5/1987 | Kaku et al. | 417/269 |
| 4,797,011 | 1/1989 | Saeki et al. | 384/912 |
| 4,927,715 | 5/1990 | Mori | 384/912 |

FOREIGN PATENT DOCUMENTS

| | | | |
|---|---|---|---|
| 24304 | 2/1979 | Japan | 417/269 |
| 221749 | 12/1984 | Japan | 417/269 |

*Primary Examiner*—Edward K. Look
*Assistant Examiner*—F. Daniel Lopez
*Attorney, Agent, or Firm*—Brooks Haidt Haffner & Delahunty

[57] ABSTRACT

A swash plate type compressor is provided with a surface coating layer on the surface of a swash plate. The surface coating layer acts to prevent the frictional resistance which leads to seizure conventionally occurring by the direct contact of the shoes and the swash plate body. The swash plate body is produced from aluminum or aluminum alloy and the surface coating layer is made of tin and at least one metal selected from the group consisting of copper, nickel, zinc, lead and indium.

10 Claims, 3 Drawing Sheets

SWASH PLATE TYPE COMPRESSOR HAVING A SURFACE COATING LAYER ON THE SURFACE OF SWASH PLATE

BACKGROUND OF THE INVENTION

1. Field of the Invention

The present invention relates to a swash plate type compressor for compressing a refrigerant gas by rotations of a swash plate, and more particularly relates to an improvement to a sliding surface of the swash plate to provide it with excellent seizure resistance with shoes although it is exposed to extremely severe working conditions during the high load operation of the compressor.

2. Description of the Prior Art

Conventionally, a swash plate type compressor is used in systems such as an air conditioning system of an automobile. According to a known swash plate type compressor, the transmission of motive power is carried out as a swash plate rotates and shoes are slidably rolled between the swash plate and a piston to reciprocate the piston, thereby suctioning, compressing and discharging the gas. The swash plate is usually composed of aluminum or aluminum alloy and the shoes are composed of iron or ceramics such as alumina in consideration of the weight reduction of the parts. The swash plate has slidable contacts with the shoes when it rotates.

In the conventional swash plate type compressor, the following problems are likely to occur.

1). Under such unfavorable circumstance as when the refrigerant leaks outside from the swash plate type compressor, the absolute amount of oil contained in the refrigerant gas is decreased. If the swash plate type compressor is operated under this state, lubrication at the sliding surface of the swash plate is decreased and, in an extreme case, seizure of the shoe at the sliding surface of the swash plate occurs due to the generation of high temperature friction heat.

2). Also, in the case where the compression of a liquid refrigerant takes place, the lubrication at the sliding surface of the swash plate is decreased. As a result, seizure of the shoe at the sliding surface of the swash plate may possibly occur.

SUMMARY OF THE INVENTION

For obviating the foregoing defects, it is the object of the present invention to provide a novel swash plate type compressor with improved seizure resistance.

The swash plate type compressor of the present invention is characterized in that the swash plate is provided with a surface coating layer at least on part of the surface having slidable contact with the shoes.

BRIEF DESCRIPTION OF THE DRAWINGS

Further objects and advantages of the present invention will become apparent from the ensuing descriptions, reference being made to the accompanying drawings, wherein.

DETAILED DESCRIPTION OF THE INVENTION

Figure 1:
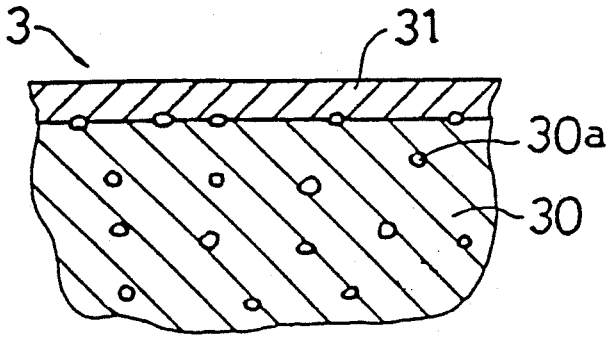
FIG. 1 is a cross sectional view of a portion of a of the swash plate in accordance with the present invention.

The swash plate type compressor of the present invention is characterized in that the swash plate body is composed of aluminum or aluminum alloy and has a surface coating layer. The surface coating layer is formed on the surface of the swash plate body at least on the part having slidable contact with the shoes. The swash plate type compressor in accordance with the present invention has a mechanical structure similar to those of conventional compressors except for the structure of the swash plate. The most characteristic feature of the present invention resides in that the swash plate is provided with a surface coating layer comprising tin and at least one metal selected from the group consisting of copper, nickel, zinc, lead and indium. The more detailed structure and the composition of the swash plate body and the surface coating layer will be described below.

The shape of the swash plate according to the present invention may be the same as those of the conventional swash plates. The material composing the matrix of the swash plate body should be aluminum or aluminum alloy. The aluminum alloy can be, for example, aluminum-high-silicon type alloy, aluminum-silicon-magnesium type alloy, aluminum-silicon-copper-magnesium type alloy and, aluminum alloys containing no silicon.

Preferably, the material for the swash plate body contains hard grains. Hard gain as used herein means grain having average particle diameters of 20 through 100 micrometer and a hardness greater than 300 on the Vickers hardness scale or, more preferably, having a hardness greater than 600 on the Vickers hardness scale, such as primary crystal silicon. For example aluminum-high-silicon type alloy (hereinafter referred to as "alsil" alloy) can be considered as one of the most suitable materials for the swash plate body. Because alsil alloy contains about 13% to 30% by weight of silicon meaning that alsil alloy contains more silicon than is required to form a eutectic crystal structure, alsil alloy has primary crystal silicon dispersed in the matrix structure. Also alsil alloy has superior sliding characteristics an could withstand very severe sliding operations at the swash plate.

Other materials having the hard grains and possibly applicable to the swash plate body are the intermetallic compounds of: aluminum-manganese; aluminum-silicon-manganese; aluminum-iron-manganese; aluminum-chromium and the like.

According to the present invention, the swash plate body has a surface coating layer. The surface coating layer is formed on the surface of the swash plate body at least on the part having slidable contact with the shoes. The surface coating layer may be formed over the whole surface of the swash plate body. The surface coating layer acts to reduce frictional resistance with the shoes and prevents the occurrence of seizure at the sliding surface of the swash plate.

The surface coating layer is composed of tin and at least one metal selected from the group consisting of copper, nickel, zinc, lead and indium. If the surface coating layer is composed only of tin the coefficient of friction will be lowered but at the same time, the surface coating layer become rather soft due to the characteristics of tin and, as a result, the surface coating layer will be susceptive to abrasion.

It is found by the inventors of the present invention that the coexistent of tin and one or more than two of copper, nickel, zinc, lead and indium in the matrix structure of the surface coating layer provides a low coefficient of friction as well as improved hardness, by which the property of high abrasion resistance is obtained. Through the research by the inventors, it is also found that the composition ratio of tin and one or more than two of copper, nickel, zink, lead and indum can be varied depending on the required characteristics of the finished surface coating layer. For example, in the case where copper is used with tin, the amount of copper is preferably from 0.1 to 50%, by weight. It is because if copper is contained less than 0.1% by weight, the effect of the copper with tin in the composition become too small and will not improve the property of abrasion resistance of the surface coating layer. On the other hand, if copper is contained more than 50% by weight, copper decreases an influence of tin and will cause the increase in friction resistance with the shoes. Further, it is more preferable that the amount of copper in the composition ranges from 0.8 to 1.2%, by weight. Furthermore, it is preferable that the surface coating layer contains a solid lubricant in addition to the above composition in order to further lower the frictional resistance. For the solid lubricant, the following powders can be used: fluororesin, molybdenum disulfide, carbon, boron nitride and the like.

The surface coating layer can be produced by such methods as chemical plating, C.V.D. process, vapor deposition, and P.V.D. process such as sputtering etc. Of all the possible processes, chemical plating is the best recommended because of the following reasons:

1). A eutectoid layer having the eutectoid structure of tin and the other metals such as copper can be formed easily.

2). If the solid lubricant such as the powders of fluororesin, molybdenum disulfide and the like is added in the aqueous solution used in the chemical plating process, they can be easily merged into the structure of the surface coating layer.

The thickness of the surface coating layer is preferably from 1 to 5 micrometers. It is because if the surface coating layer has a thickness of less than 1 micrometer, the coefficient of friction will not be sufficiently lowered. On the other hand, if the surface coating layer has a thickness of more than 5 micrometers, the surface coating layer will be susceptive to problems concerning its strength such as to resists peeling-off.

According to the swash plate type compressor of the present invention, the swash plate has the surface coating layer formed at least on part of the surface having slidable contact with the shoes. The surface coating layer is composed of tin and at least one metal selected from the group consisting of copper, nickel, zinc, lead and indium. Conventionally, the swash plate body made of aluminum or aluminum alloy directly contacts the shoes. However, according to the present invention, the surface coating layer on the swash plate body contacts the shoes so that the frictional resistance with the shoes is greatly reduced.

Further, according to the present invention, coefficient of friction between the swash plate and the shoe is small so that the smooth sliding of the shoe on the swash plate is ensured. Accordingly, the smooth running of the swash plate type compressor is performed.

Furthermore, according to the present invention, the surface coating layer is superior in strength thereby reducing the amount of abrasion which occurs thereon.

Still further, seizure of the shoe to the surface of the swash plate is prevented even when a liquid refrigerant is compressed or the compressor is operated under unfavorable circumstances such as insufficient lubrication of the sliding parts caused by leaks of refrigerant gas to the outside of the compressor.

Consequently, by the effects described above, the swash plate type compressor according to the present invention can satisfactorily withstand very severe use and achieve long service life.

PREFERRED EMBODIMENTS OF THE INVENTION

Preferred embodiments of the invention will now be described in detail with reference to the accompanying drawings. The mechanical structure of the swash plate type compressor shown in FIG. 5 was employed throughout the embodiments 1 to 6, the comparative example and the conventional type example.

Figure 5:
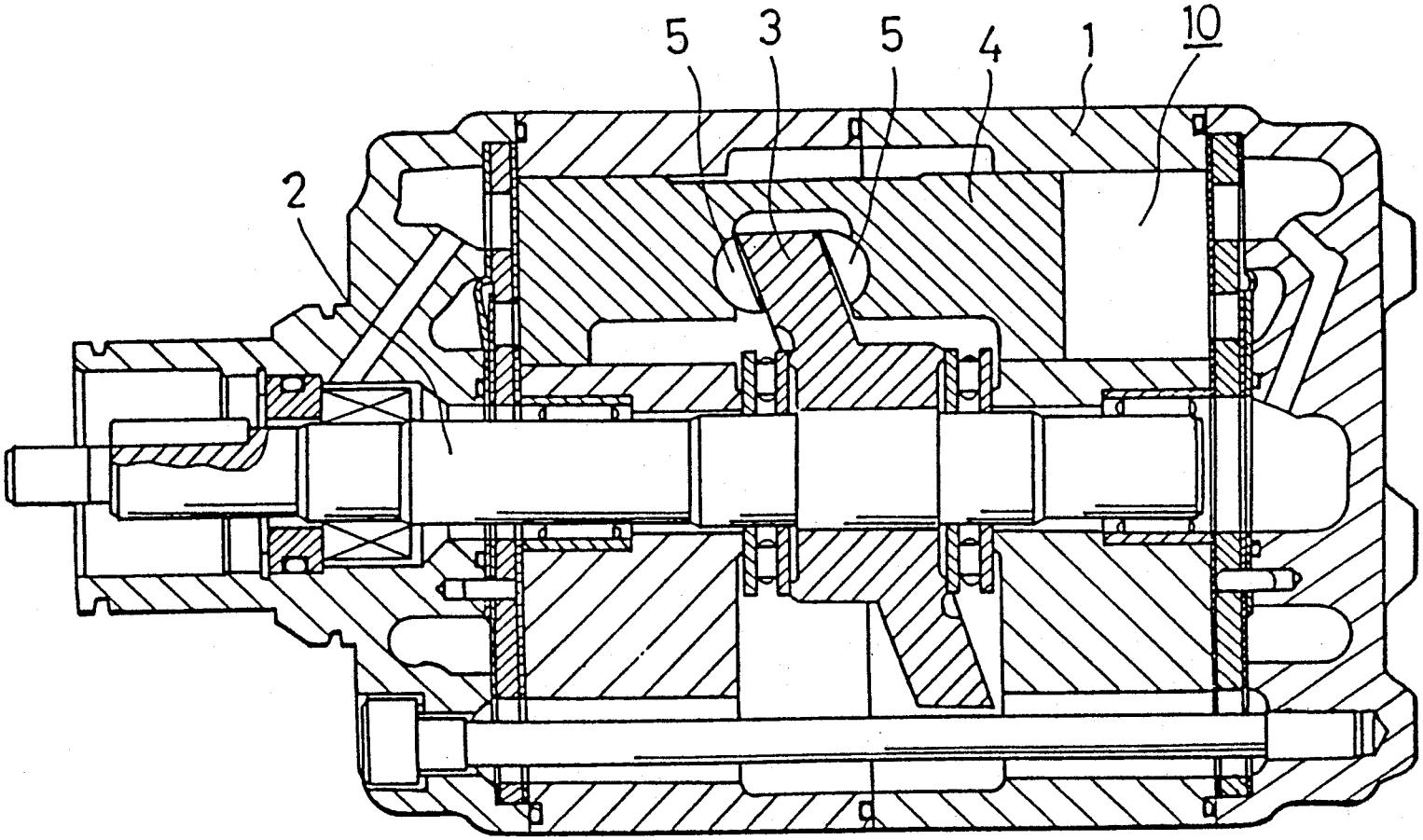
FIG. 5 is a sectional view showing the mechanical structure of the swash plate type compressor according to the present invention.

As is shown in FIG. 5, the swash plate type compressor of the present invention comprises a cylinder block 1 which includes a cylinder bore 10 disposed in parallel to the axis of the cylinder block 1; a rotary shaft 2 rotatably held within the cylinder block 1; a swash plate 3 fixed to the rotary shaft 2 which rotates within the cylinder block 1; a piston 4 reciprocally fitted in the cylinder bore 10; and shoes 5 slidably disposed between the piston 4 and the swash plate 3 which reciprocate the piston 4 by the rotations of the swash plate 3. Accordingly, as the swash plate 3 rotates with the rotary shaft 2, the shoes 5 are rolled to reciprocate the piston 4 so that the intake, compressing and discharging of the gas can take place.

EMBODIMENT 1

According to the swash plate type compressor of the embodiment 1, as shown in FIG. 1, the swash plate 3 is composed of a swash plate body 30 made of alsil alloy containing 17% by weight of silicon, and a surface coating layer 31 formed on the whole surface of the swash plate body 30. In the matrix structure of the swash plate body 30, primary crystal silicon **30*a* were dispersed. The surface coating layer 31** was a eutectoid plating layer consisting of tin and zinc.

The surface coating layer 31 was formed by the following process:

The swash plate body 30 was immersed for 3 minutes into a aqueous solution which contains 6% potassium stannate and 0.005% zinc sulfate, by weight, and which was kept at 60 through 80 degrees centigrade. It was then electrolytically plated, taken out from the solution and water washed. As a result, a eutectoid plating layer consisting of tin and zinc were formed over the whole surface of the swash plate body 30. The resultant surface coating layer 31 had a thickness of 1 micrometer and was composed of 97% tin and 3% zinc, by weight.

EMBODIMENT 2

The swash plate body 30 was made just like in the embodiment 1 but a different composition for the surface coating layer 31 was applied as follows:

an aqueous solution containing 6% potassium stannate and 0.005% nickel chloride, by weight, was prepared and the same electrolytic plating process applied to the embodiment 1 was performed. As a result, the surface coating layer 31 formed a eutectoid plating layer consisting of tin and nickel was formed over the surface of the swash plate body 30. The resultant surface coating layer 31 had a thickness of 1 micrometer and was composed of 98% tin and 2% nickel, by weight.

EMBODIMENT 3

The swash plate body 30 was made just like in the embodiment 1 but a different composition for the surface coating layer 31 was applied as follows:

an aqueous solution containing 6% potassium stannate and 0.003% copper sulfate, by weight, was prepared and the same electrolytic plating process applied to the embodiment 1 was performed. As a result, the surface coating layer 31 in the form of a eutectoid plating layer consisting of tin and copper was formed over the surface of the swash plate body 30. The resultant surface coating layer 31 had a thickness of 1.2 micrometers and was composed of 99% tin and 1% copper, by weight.

EMBODIMENT 4

The swash plate body 30 was made just like in the embodiment 1 but a different composition for the surface coating layer 31 was applied as follows:

an aqueous solution containing 6% potassium stannate and 0.005% indium sulfate, by weight was prepared and the same electrolytic plating process applied to the embodiment 1 was performed. As a result, the surface coating layer 31 in the form of a eutectoid plating layer consisting of tin and indium was formed over the surface of the swash plate body 30. The resultant surface coating layer 31 had a thickness of 1 micrometer and was composed of 97% tin and 3% indium, by weight.

EMBODIMENT 5

The swash plate body 30 was made just like in the embodiment 1 but a different composition for the surface coating layer 31 was applied as follows:

an aqueous solution containing 6% potassium stannate and 0.007% lead sulfate, by weight was prepared and the same electrolytic plating process applied to the embodiment 1 was performed. As a result, the surface coating layer 31 in the form of a eutectoid plating layer consisting of tin and lead was formed over the surface of the swash plate body 30. The resultant surface coating layer 31 had a thickness of 2 micrometers and was composed of 95% tin and 5% lead, by weight.

EMBODIMENT 6

The swash plate body 30 was made just like in the embodiment 1 but a different composition for the surface coating layer 31 was applied as follows:

an aqueous solution containing 6% potassium stannate and 0.003% copper sulfate, by weight was prepared. And in addition, 1.0% by weight of fluororesin powder was dispersed in the solution. Then the same electrolytic plating process applied to the embodiment 1 was performed. As a result, the surface coating layer 31 in the form of a eutectoid plating layer consisting of tin and copper with fluororesin powder was formed over the surface of the swash plate body 30. The resultant surface coating layer 31 had a thickness of 1.4 micrometers and composed of 99% tin, 0.9% copper and 0.1% fluororesin powder, by weight.

A COMPERATIVE EXAMPLE

The swash plate body was made just like in the embodiment 1 but a different composition for the surface coating layer 31 was applied as follows:

an aqueous solution containing 6% potassium stannate by weight was prepared and the same electroless plating process applied to the embodiment 1 was performed. As a result, the surface coating layer 31 in the form of a eutectoid plating layer consisting of tin was formed over the surface of the swash plate body 30. The resultant surface coating layer 31 had a thickness of 1.5 micrometers and was composed of 100% tin, by weight.

CONVENTIONAL TYPE EXAMPLE

A mechanical structure of the swash plate type compressor according to a conventional type was made just like in the above described embodiments 1, but in this example, the surface coating layer was not provided on the surface of the swash plate.

EXPERIMENTAL TESTS

Several tests were conducted to evaluate the swash plates produced in accordance with the embodiments 1 to 6 of the present invention, the comparative example and the conventional type example.

The first test was conducted to measure the frictional coefficient of each swash plate with a shoe by using a friction and abrasion tester. The material for a mating shoe was a bearing steel SUJ2 (Japanese Industrial standard). The applied rotation speed was 1000 r.p.m. under a load of 10 kg, in a dry state.

Figure 2:
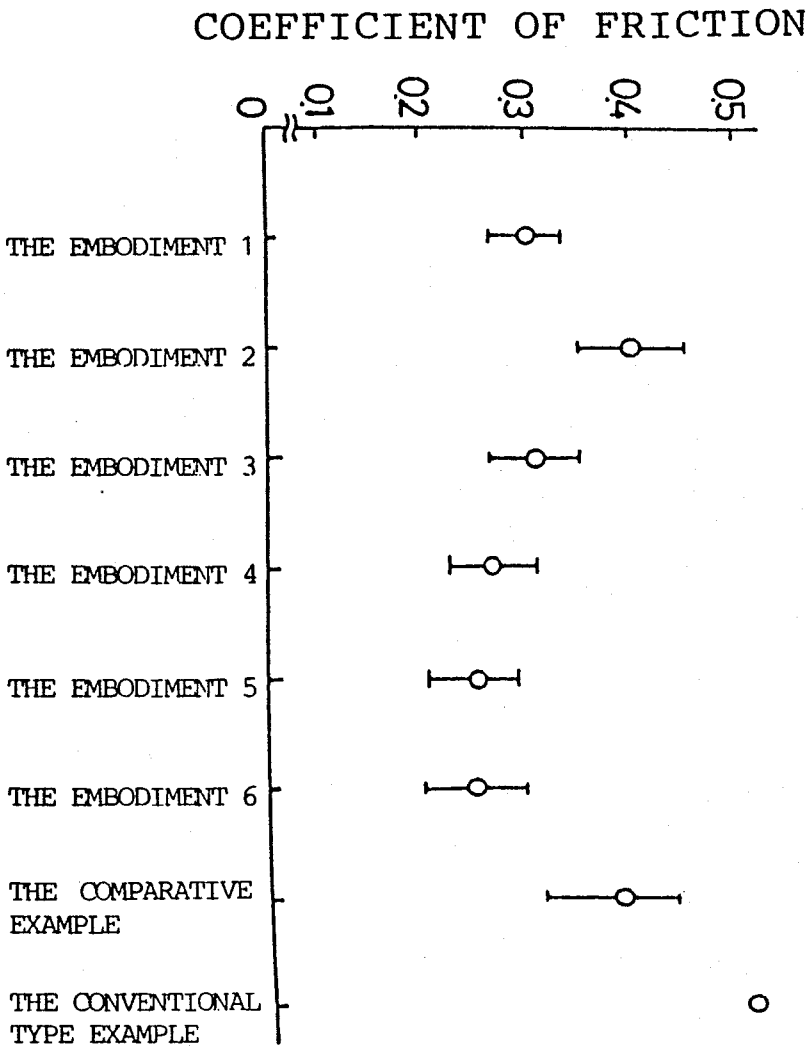
FIG. 2 is a graph showing the amount of coefficient of friction measured at the surface of the swash plate in contact with a shoe.

The same test was conducted for four times and the results were shown in FIG. 2.

As is indicated in FIG. 2, coefficients of friction measured for the swash plates having the surface coating layer in accordance with the embodiments of the present invention were much lower than that for the conventional type example. Also, a the comparison between embodiments 3 and 6 of the present invention, shows that the addition of fluororesin powder in the composition of the surface coating layer is effective in lowering the coefficient of friction as shown in FIG. 2. It is also known that although the swash plate of the comperative example shows a low coefficient of friction, the surface coating layer of this example has a lower hardness than those of the embodiments 1–6. Thus, the surface coating layer of the comparative example is more susceptive to rapid abrasion.

Next, a liquid compression test was conducted so as to measure the occurrence of seizures at the sliding parts exposed to severe working conditions. The swash plate type compressor of the embodiment 3 according to the present invention and the conventional type example were tested.

Figure 3:
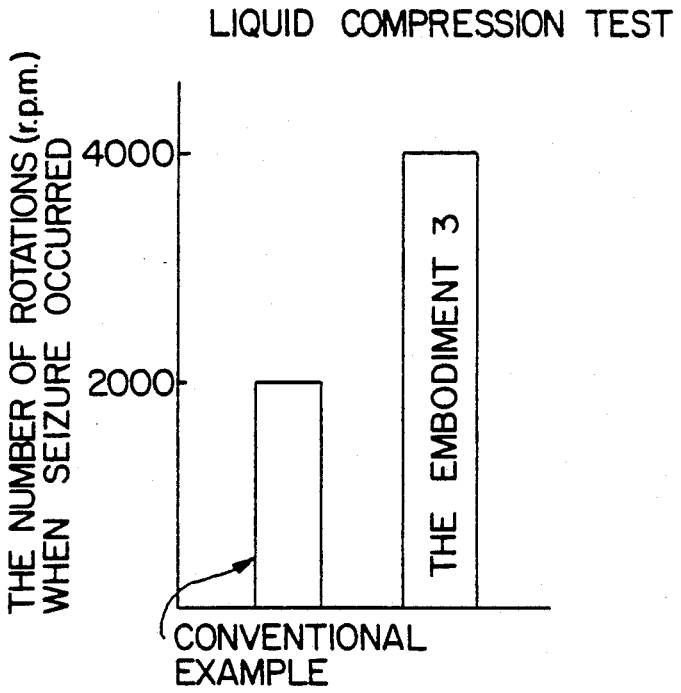
FIG. 3 is a graph showing the number of rotations per minute (r.p.m.) of the swash plates when seizure occurred in a liquid compression test.

The material for a mating shoe was also a bearing steel SUJ2 (Japanese Industrial Standard). The ambient temperature was set to 0 degrees centigrade. According to the test, the rotations speed (r.p.m.) of the swash plate was measured when seizure of the shoe at the surface of the swash plate took place. The result is shown in FIG. 3. As is shown in FIG. 3, for the swash plate of the conventional type example, seizure occurred at 2000 r.p.m. with the swash plate of the embodiment 3, seizure occurred at a higher rotation speed of 4000 r.p.m.

Figure 4:
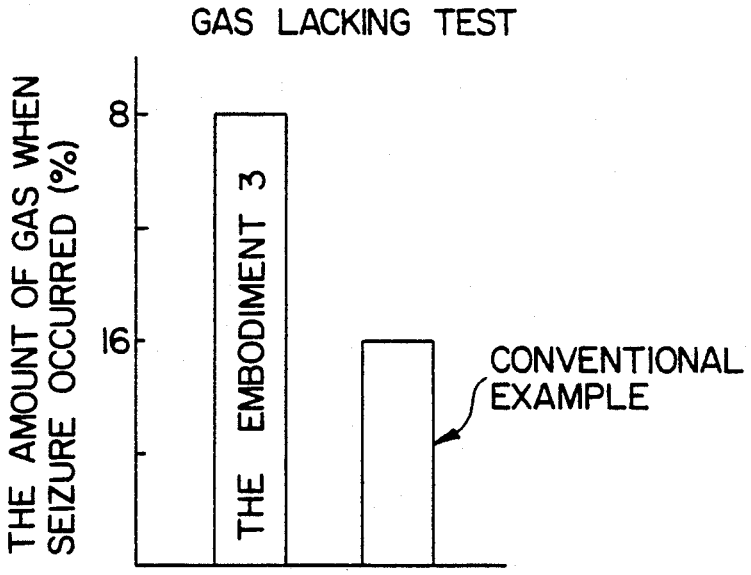
FIG. 4 is a graph showing the amount of residual gas in the swash plate type compressors when seizure occurred in a gas leaking test.

Then, a gas leaking test was effected while decreasing the amount of refrigerant gas in the compressor. The residual amount of the gas was measured when seizure took place. The same swash plate type compressor and the shoe used in the liquid compression test were used. The ambient temperature was set at 20 degrees centigrade and the applied rotations speed of the swash plate was 4500 r.p.m. The result was shown in FIG. 4. As is shown in FIG. 4, for the swash plate of the conventional example, seizure occurred when the gas was reduced to 16% of the predetermined level. However, for the swash plate of the embodiment 3, seizure did not occur until the gas was reduced to 8% of the predetermined level.

As is apparent from the test results shown in FIG. 3 and FIG. 4, according to the present invention, the occurrence of seizure of the swash plate is greatly reduced due to the effect of the surface coating layer although the swash plate type compressor is operated under severe conditions.

Also, according to the present invention, even in the state where the surface coating layer of the swash plate is gradually reduced by abrasion, the primary crystal silicon dispersed on the surface of the swash plate body was exposed and sticks on the swash plate surface. Since primary crystal silicon has a great hardness, the further abrasion of the surface coating layer is prevented.

It will be obvious to those skilled in the art that various changes may be made without departing from the scope of the invention and the invention is not to be considered limited to what is shown in the drawings and described in the specification.

What is claimed is:

1. A swash plate type compressor comprising:

a cylinder block having a cylinder bore disposed parallel to the axis of said cylinder block;

a rotary shaft rotatably mounted within said cylinder block;

a swash plate fixed to said rotary shaft for rotation with said rotary shaft within said cylinder block;

a piston reciprocally fitted in said cylinder bore; and shoes which slidably intervene between said piston and said swash plate and reciprocate said piston by rotations of said swash plate;

wherein said swash plate comprises a matrix composed of aluminum or aluminum alloy and at least a part of the surface of said swash plate is coated with a surface coating layer comprising at least 50% by weight of tin and the balance substantially comprising at least one metal selected from the group consisting of copper, nickel, zinc, lead and indium, and said part of the surface of said swash plate is in slidable contact with said shoes.

2. The swash plate type compressor of claim 1, wherein said matrix of said swash plate contains hard grains having an average particle diameter of from 20 to 100 micrometers and a hardness greater than 300 on the Vickers hardness scale.

3. The swash plate type compressor of claim 2, wherein said matrix of said swash plate contains hard grains having the hardness greater than 600 on the Vickers hardness scale.

4. The swash plate type compressor of claim 1, wherein said matrix of said swash plate comprises aluminum-high-silicon type alloy which includes 13% to 30% silicon by weight.

5. The swash plate type compressor of claim 5, wherein the copper content in the composition of said surface coating layer is from 0.1% to 50%, by weight.

6. The swash plate type compressor of claim 5, wherein the copper content in the composition of said surface coating layer is from 0.8% to 1.2%, by weight.

7. The swash plate type compressor of claim 1, wherein said surface coating layer contains solid lubricant powders selected from the group consisting of fluororesin, molybdenum disulfide, carbon and boron nitride.

8. The swash plate type compressor of claim 1, wherein said surface coating layer is an eutectoid plating layer.

9. The swash plate type compressor of claim 1, wherein the thickness of said surface coating layer is from 1 to 5 micrometers.

10. The swash plate type compressor of claim 1, wherein said composition consists of at least 95% by weight of tin.

* * * * *

UNITED STATES PATENT AND TRADEMARK OFFICE

CERTIFICATE OF CORRECTION

PATENT NO. : 5,056,417

DATED : October 15, 1991

INVENTOR(S) : M. Kato et al

It is certified that error appears in the above-identified patent and that said Letters Patent is hereby corrected as shown below:

Col. 1, line 64, delete last words "of the".

Col. 2, line 52, "an" should read --and--.

Col. 3, line 4, after "tin" insert comma --,--.

Col. 3, line 27, "an" should read --the--; "the" should read --an--; line 58, after "strength" insert comma --,--; "resists" should read --resist--.

Col. 4, line 43, "compressing and discharging" should read --compression and discharge--.

Col. 6, line 47 delete "the".

Col. 7, line 4, "with" should read --With--.

Col. 8, line 27 "claim 5" should read --claim 1,--.

Signed and Sealed this

First Day of June, 1993

*Attest:*

Michael K. Kirk

MICHAEL K. KIRK

*Attesting Officer*

*Acting Commissioner of Patents and Trademarks*